United States Patent [19]

Little

[11] Patent Number: 4,547,162

[45] Date of Patent: Oct. 15, 1985

[54] SPUD SUPPORT FOR USE IN WATER OF EXCESSIVE DEPTH

[75] Inventor: Charles D. Little, Graceland Park, Md.

[73] Assignee: Ellicott Machine Corporation, Baltimore, Md.

[21] Appl. No.: 700,069

[22] Filed: Feb. 11, 1985

Related U.S. Application Data

[63] Continuation of Ser. No. 506,514, Jun. 21, 1983, abandoned.

[51] Int. Cl.[4] ..... B63H 19/00

[52] U.S. Cl. ..... 440/36; 37/73

[58] Field of Search ..... 440/34, 36; 114/230; 37/54, 73, 74, 76, 77; 405/203

[56] References Cited

U.S. PATENT DOCUMENTS

| | | | |
|---|---|---|---|
| 1,134,708 | 4/1915 | Watkins | 37/73 |
| 2,092,011 | 9/1937 | Musham | 37/73 |
| 3,769,802 | 11/1973 | Wefer | 37/73 |
| 4,399,623 | 8/1983 | Neumann | 37/73 |

*Primary Examiner*—Jesus D. Sotelo

*Attorney, Agent, or Firm*—Scrivener Clarke Scrivener and Johnson

[57] ABSTRACT

A pair of normal sized anchoring spuds for use in water of moderate depth are mounted for reciprocal movement in a single, reciprocal spud support member which may be lowered into water of abnormal depth, with the spuds cooperating with the support member as if they were operating in water of moderate depth.

9 Claims, 5 Drawing Figures

SPUD SUPPORT FOR USE IN WATER OF EXCESSIVE DEPTH

This application is a continuation, of application Ser. No. 506,514, filed June 21, 1983, now abandoned.

SUMMARY OF THE INVENTION This invention relates to spuds for dredges and more particularly to an arrangement for using spuds of conventional size for anchoring dredges in exceptionally deep water.

BACKGROUND OF THE INVENTION

Though the present invention is applicable to the mooring or anchoring of any floating body in deep water and particularly to mooring dredges, it will be described primarily in connection with bucket wheel dredges which, as a result of the invention have been made available for dredging, and particularly mining, in waters of excessive depth i.e. between 100 and 200 feet or more.

Bucket wheel dredges for mining minerals, such as coal, and continuously delivering the same to a shoreside point of use, such as a generating plant, are well known. In certain areas of the world, deposits of coal are located on the bottoms of lakes having depths of around 200 feet or more and it has been proposed to erect generating plants on the shore of such lakes and deliver continuously to the plants coal dredged from the bottom of the lakes. Clam shell dredges are relatively slow and inefficient for supplying coal at the required rate and cutter suction dredges are not efficient for mining coal. On the other hand bucket wheel dredges are ideal for such use but, prior to the present invention could not be used efficiently in deep water because the usual means for mooring dredges in such depth was by the use of anchors and flexible cables which do not provide sufficiently accurate or stable positioning of a dredge barge to permit the use of bucket wheels, which exert greater forces on the dredge than do conventional cutters. As a practical matter, therefore, spuds are essential for use with bucket wheel dredges but spuds could not be used in deep water because of the excessive mass required to resist bending forces, the excessive mass of the machinery required to handle such spuds, and the excessive heights the spuds would extend above the water surface when fully elevated to their transport position.

The broad object of the present invention is to provide improved means enabling spud mooring of a floating body in water of exceptional depth.

More particularly it is an object of the invention to provide the foregoing improved spud mooring means in combination with a dredge and particularly, a bucket wheel dredge.

Other objects and their attendant advantages will become apparent as the following detailed description is read in conjunction with the accompanying drawings.

BRIEF DESCRIPTION OF THE INVENTION

The invention utilizes conventional spuds of the usual size and length for use in water of moderate depth, that is to say, spuds having a length substantially less than the depth of the exceptionally deep water in which the dredge is to operate. A pair of spuds are mounted for independent vertical movement in a single sleeve-like spud support member which itself is vertically movable. For use in maximum depth, the support member is lowered to its maximum and the spuds are thereafter lowered in sequence in the normal manner, the lateral support for the spuds comprising wells located adjacent only the lower end of the support member whereby the spuds of normal size operate in a normal manner as if the water depth were a normal amount. The sleeve, which is of robust dimensions, transfers lateral force from the barge through one of the wells to whatever spud is engaging the bottom as if that spud were supported normally in its well directly at the rear of the barge the wells adjacent the lower end of the support member providing the sole lateral support for the spuds relative to the support member exactly as the wells would if they were in their conventional position connected to the rear of the barge. The sleeve may be rotatable to enable the barge to be advanced in the direction of or away from the dredging cut.

Figure 1:
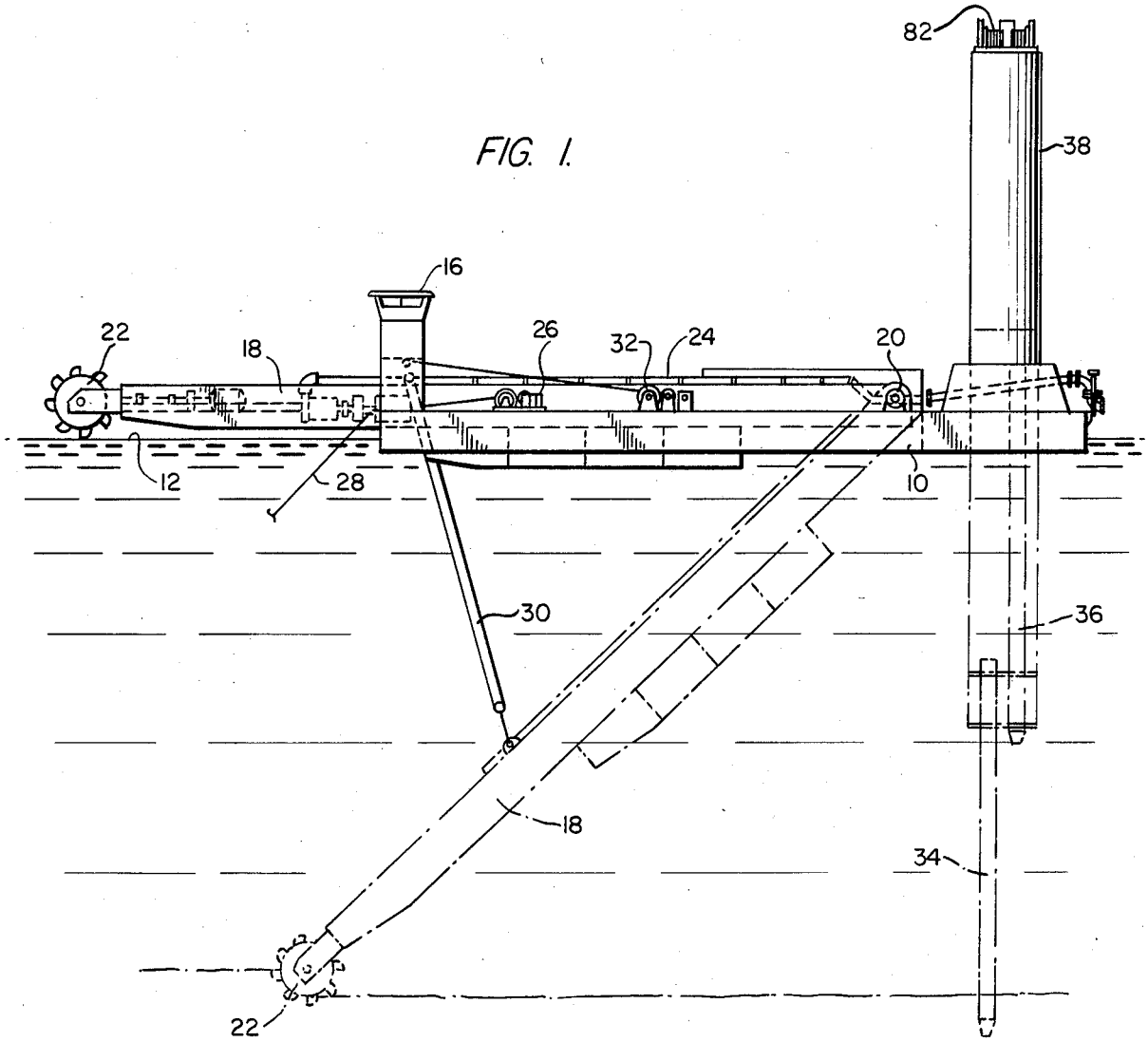
FIG 1. is a side elevational view of a bucket wheel dredge showing the present invention.
Figure 2:
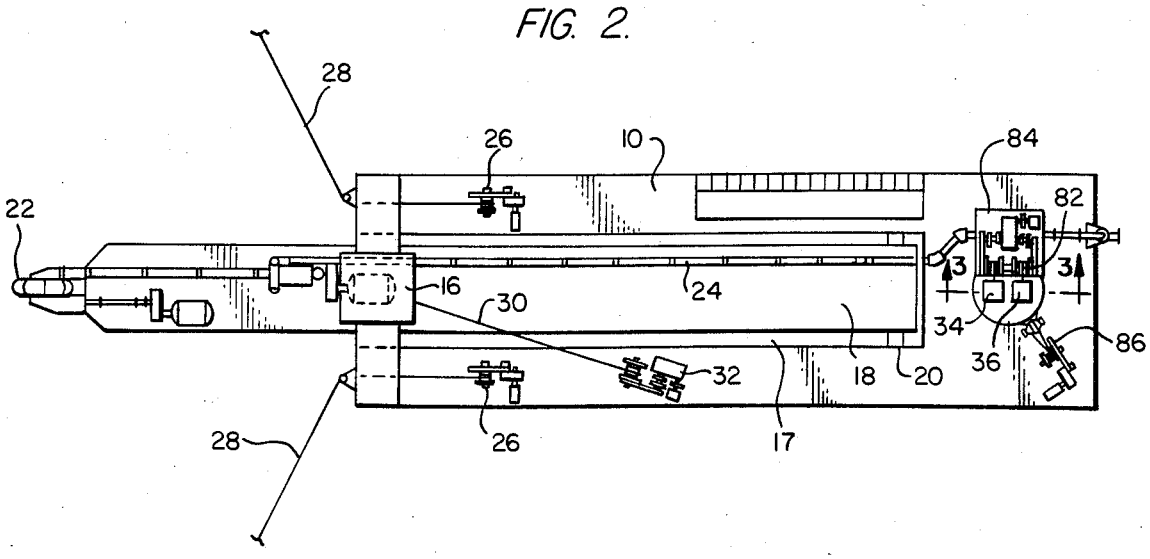
FIG. 2 is a top plan view of the dredge of FIG. 1.

Referring now to the drawings and particularly to FIGS. 1 and 2, 10 designates a dredge barge floating on the surface 12 of a body of water of an exemplary depth of about 200 feet. The dredge is provided with a control house 16 spanning the forward end of a central elongated U-shaped recess 17 in the barge hull designed to accommodate a dredge ladder 18 pivoted at one end 20 to the hull and extending forwardly, when in its solid-line, housed or raised position of FIGS. 1 and 2, a distance substantially in excess of the depth of the water on which the barge floats. Rotatably mounted on the opposite end of the ladder is a bucket wheel 22 which, when the ladder 18 is lowered to its phantom lines working position of FIG. 1 is driven in a known manner to excavate bottom material which is delivered by the buckets to a suction hopper in the central portion of the wheel from which the material is pumped in a known manner by a dredge pump and delivered through a pipe line 24 to the rear of the barge from whence the material is conveyed by a continuation of the line to a place of disposal or use remote from the dredge.

The forward end of the barge is connected by winches 26 and cables 28 to a pair of anchors (not shown), the ladder being swung across the cut by coordinated operation of the winches to pay in and let out the cables as well known in the art. The position of the ladder 18 is controlled by a cable 30 leading to a power winch 32.

For dredging in water depths of 100 feet or less the rear of a dredge barge is normally moored or anchored to the bottom by a pair of spuds, one spud being lowered to penetrate the bottom while the other is raised as the dredge is swung by manipulation of the bow anchor cables 28, across the cut, pivoting on the one lowered spud. The spuds are raised and lowered alternately in order to step ahead the dredge. As well known in the art cutter suction dredging is usually performed during a sweep in one direction only, especially when dredging hard material. A bucket wheel dredge excavates during sweeps in both directions.

For bucket wheel dredging, which is preferred for mining certain minerals, particularly coal deposits on the bottom of waterways, the bucket wheel must be accurately positioned relative to the face of the cut and optimum positioning can only be obtained by the use of spuds. In water of exceptional depth between 100 and 200 feet or more, it has heretofore been impractical to use spuds for the reasons pointed out above and the substitute for spuds, stern anchors and cables, do not provide sufficient rigidity to the barge to permit efficient use of bucket wheels, though stern anchors are acceptable for use with cutter suction dredges which, however, are often not suitable for excavating some minerals, particularly coal.

Figure 5:
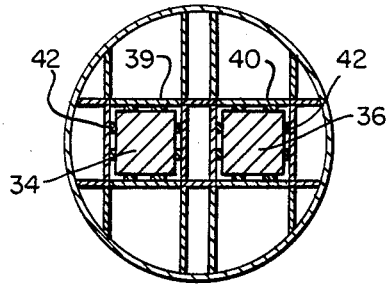
FIG. 5 is a horizontal cross sectional view taken substantially on the lines 5—5 of FIG. 3.
Figure 4:
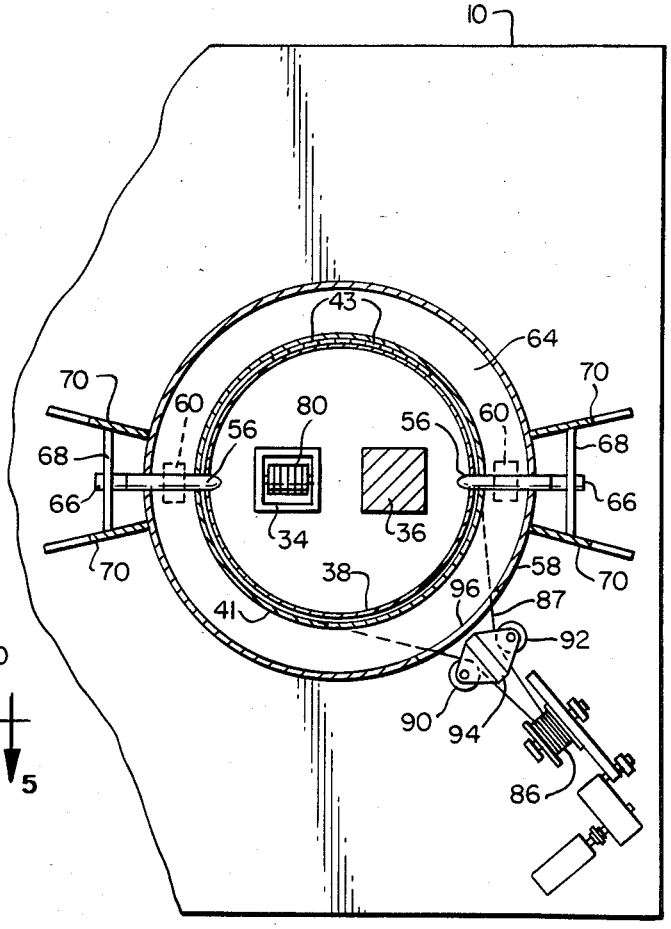
FIG. 4 is a horizontal cross sectional view taken substantially on the line 4—4 of FIG. 4.

The present invention provides a solution to the above problems by mounting conventionally sized spuds 34, 36 within a single support member 38. The support member may have a length approximately equal the length of a conventional spud and at it lower end it is provided with guide or spud wells 39, 40 for the respective spuds 34, 36. The spud wells are desirably lined with removable wear strips 42, better seen in FIG. 5, which also provide additional clearance should it be necessary to remove a bent spud. The spud wells 39, 40 are essentially the same as the conventional wells normally secured to the dredge barge itself for use in dredging in normal depths. As can be seen the wells 39, 40 adjacent the lower end of the support member provide the sole lateral support for the spuds relative to the support member exactly as the wells would if they were in their conventional position connected directly to the barge.

Figure 3:
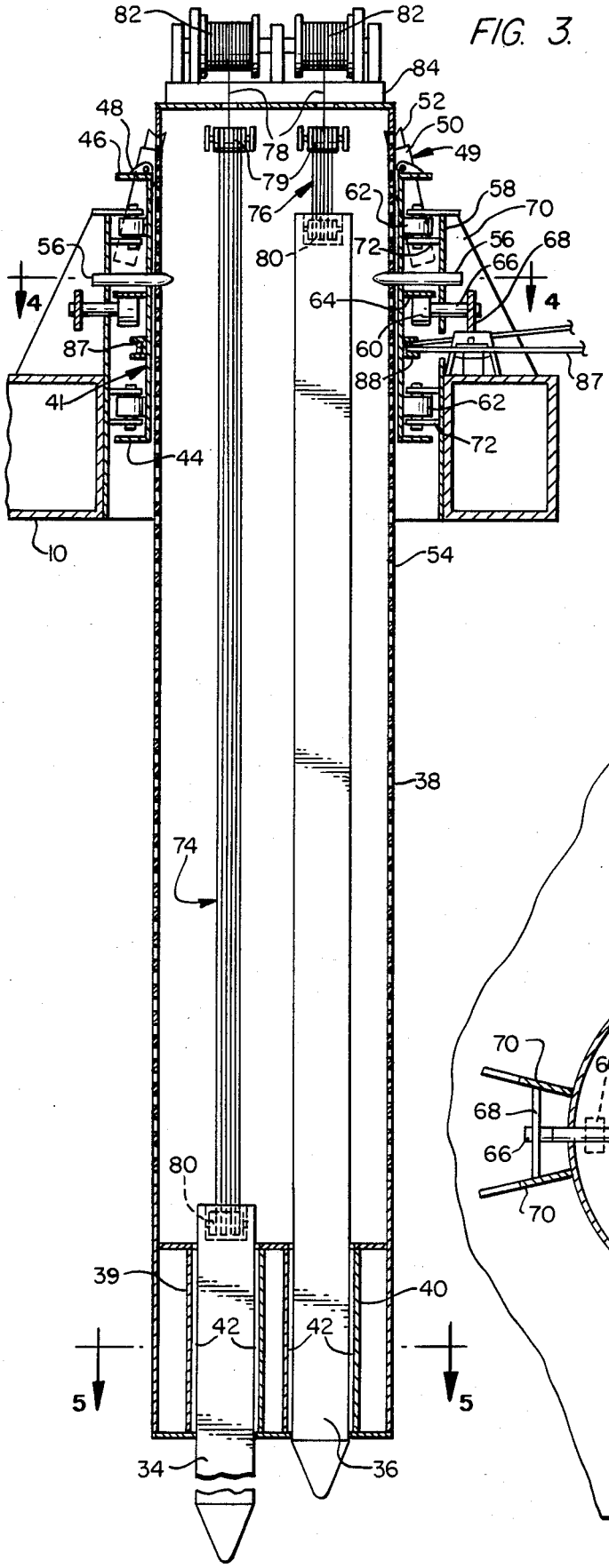
FIG. 3 is an enlarged vertical cross sectional view taken substantially on the line 3—3 of FIG. 2.

The support member 38 is shown in FIG. 3 lowered to its maximum extent. The support member 38 is movable vertically in a cylindrical guide member 41 and is keyed thereto by splines 43 which permit the member 38 to move vertically relative to cylindrical member 41 while preventing relative rotary motion between the two members. The guide member 41 has horizontal flanges 44, 46 at its lower and upper ends. The upper flange carries brackets 48 pivotally supporting jacks 49 comprising hydraulic cylinders 50 containing pistons 52 having notched outer ends engageable with any one of a series of vertically spaced openings 54 in the wall of the support member 38.

The vertically spaced openings 54 also receive removable retaining pins 56 which extend through openings in the wall of a fixed cylindrical member 58 and the guide member 41, which itself may be fixed in any suitable manner to the member 58, though desirably the member 41 is supported by vertical and horizontal rollers 60, 62 for rotation about a vertical axis with respect to the barge. Where the members 38, 41 are rotatable the member 41 may be provided with a horizontal, annular flange 64 which engages the vertical rollers 60 as shown, the latter being carried by spindles 66 projecting through the wall of member 58 and suitably secured to a bracket 68 extending between radially extending upstanding brace plates 70. The horizontal rollers 62 are pivoted on spindles between vertically spaced brackets 72 fixed to the inner face of the fixed cylindrical member 58. It will be understood that as many sets of rollers may be provided as considered necessary, the rollers shown being exemplary only. Further, instead of sets of separate horizontal and vertical rollers, tapered rollers may be employed.

The weight of the sleeve is normally sustained by the pins but when it is desired to adjust the vertical position of the support member 38, the cylinders 50 are initially pressurized enough to relieve the load on the pins, which are then withdrawn whereupon the cylinders are fully pressurized to raise the member 38 to the full extent permitted by the cylinders 50, after which the pins 56 are re-inserted and the pistons retracted to engage with a lower positioned opening 54, with this process being repeated until the member 38 is at the desired elevation. The member is lowered by simply reversing the foregoing procedure.

The use of the piston and pin arrangement is exemplary only and those skilled in this art will recognize that other means such as rack and pinion may be utilized to adjust the vertical position of the support member 38.

The vertical positions of the spuds may be controlled by hoisting tackles broadly designated by the numerals 74, 76. The tackles comprise flexible cables 78 extending between pulley sets 79, 80 fixed to the interior of the member 38 and to the upper ends of the spuds, respectively. Each of the cables 78 leads to a power winch 82 mounted on a platform 84 fixed to the upper end of the support member 38. Clearly, other means can be employed such as hydraulic cylinders for controlling the spuds.

When the member 38 is rotatable for reasons explained hereinafter, it may be done so by rotation of the cylindrical member 41 which as previously explained is keyed or splined at 43 to the member 38. Though the member 41 may be rotated in any of a variety of ways, one means for rotating it is shown as comprising a power operated winch 86 fixed to the deck of the barge for controlling a cable 87 which leads from the top and bottom of the winch drum in a channel 88 around the guide member 41. Suitable horizontal pulleys 90, 92 mounted on a bracket 94 guide the cable through an opening 96 in the fixed member 58 to the channel 88. It will be understood that when the winch is operated in one direction or the other the cable is paid out from either the top or bottom of the winch drum and simultaneously taken in at the bottom or top to effect rotation of the member 38.

In use, the barge is towed to its dredging position the bow anchors are positioned and the spud support member lowered in step-wise fashion by reverse action of the jacks 49 until the wells 39, 40 are located at an appropriate depth with respect to the bottom of the waterway. One spud, say spud 34 is then lowered until it penetrates the bottom. Dredging is then commenced and, if the support member 38, is non-rotatable the spuds are dropped and raised alternately in the conventional manner, bending forces on the spuds being resisted by the wells 39, 40 and the support member 38, which is sufficiently robust to withstand bending forces over the span from the wells to the support structure at the rear of the barge.

If dredging is by bucket wheel, then the invention contemplates that the member 38 will be rotatable. Under these circumstances and in accordance with the invention, after a spud is dropped, it is advanced into the cut in small and accurate increments by rotating the support member up to 180° while the spud is in the bottom. Though the rotating feature is useful for cutter suction dredging it is extremely important for bucket wheel dredging.

When the dredge is to be transported to another site, both the spuds are elevated to their stored position within the support member and the latter is elevated to its fully raised position, with the support member extending above the barge a distance substantially no greater than conventionally sized spuds would be if they were to operate through wells fixed to the rear of the barge.

Having now described the invention, what is claimed is:

1. Means for anchoring a dredge barge or the like to the bottom of exceptionally deep water comprising a unitary, vertically reciprocal, spud support member having vertically spaced upper and lower ends, a plurality of vertically reciprocal spuds carried by said spud support member, said spuds having a length substantially less than the depth of said exceptionally deep water, means for vertically reciprocating said support member between raised and lowered positions relative to said dredge barge, means for vertically reciprocating each of said spuds relative to each other and to said spud support member, and well means carried by said support member adjacent only the lower end thereof, said well means providing the sole guide and lateral support for the spuds relative to said support member as and when the latter is lowered to a position sufficient to enable said spuds to extend from said well means into anchoring condition in said bottom.

2. The anchoring means of claim 1, wherein said spud support member is tubular and said spuds are vertically reciprocal within said support member.

3. The anchoring means of claim 2 wherein said tubular support member has a length substantially equal to the length of said spuds whereby when said spuds are hoisted to their raised position they are substantially housed within said tubular member.

4. The anchoring means of claim 2, wherein the means for vertically reciprocating each of said spuds relative to each other and to said support member comprises hoisting means carried by said tubular support member.

5. The anchoring means of claim 1 including means carried by said dredge barge for rotating said support member and the spuds carried thereby in any vertical position of said support member relative to said dredge barge.

6. The anchoring means of claim 1, said well means including a well for each of said spuds carried by said spud support member adjacent the lower end thereof.

7. The combination of a dredge comprising a barge, a ladder pivoted at one end to the barge and a bucket wheel operating at the other end of the ladder for dredging bottom matter, and means for anchoring said dredge barge in water having a depth between about 100 and 200 feet, said anchoring means comprising a pair of spuds each of a size and length for anchoring a dredge barge in water not in excess of about 100 feet in depth, a unitary rotatable spud support member of tubular configuration carried by said barge and having a length substantiallly equal to the length of said spuds, means mounting both of said spuds within said tubular spud support member, means for reciprocating said spuds within said support member, said mounting means being arranged to permit said spuds to be reciprocated within said tubular support member relative to each other and relative to said support member, means for reciprocally mounting said tubular support member on said barge, and spud well means for said spuds adjacent the lower end of said spud support member, said means for mounting said support member on said barge including a rotatable sleeve, means keying said tubular support member to said sleeve for preventing relative rotation between said sleeve and said support member while permitting said support member to be vertically reciprocal relative to said sleeve, and means for rotating said sleeve to transmit rotary motion thereof to said support member through said keying means so as to rotate said support member and said spuds relative to said barge.

8. The combination of claim 7 wherein the means for reciprocating said spuds comprise hoisting means carried by said tubular member.

9. Means for anchoring a dredge barge or the like in exceptionally deep water comprising a unitary, vertically reciprocal, rotatable spud support member, a plurality of vertically reciprocal spuds carried by said spud support member, means for vertically reciprocating said support member relative to said dredge barge, means for vertically reciprocating each of said spuds relative to each other and to said spud support member, and means for rotating said support member relative to said dredge barge, said support member including a sleeve, means keying said support member to said sleeve for preventing relative rotation between said sleeve and said support member while permitting said support member to be vertically reciprocated relative to said sleeve, said sleeve being rotatable, said means for rotating said support member being operable connected to said sleeve to transmit rotary motion thereof to said support member through said keying means.

* * * * *